US005136118A

United States Patent [19]

Buchanan et al.

[11] Patent Number: 5,136,118

[45] Date of Patent: Aug. 4, 1992

[54] HIGH VI SYNTHETIC LUBRICANTS FROM CRACKED REFINED WAX

[75] Inventors: J. Scott Buchanan, Hamilton Square; Margaret M. Wu, Belle Mead, both of N.J.

[73] Assignee: Mobil Oil Corporation, Fairfax, Va.

[21] Appl. No.: 571,347

[22] Filed: Aug. 23, 1990

[51] Int. Cl.[5] ..... C07C 2/74

[52] U.S. Cl. ..... 585/255; 585/530; 585/532; 585/7; 585/10; 585/11; 585/12; 208/106

[58] Field of Search ..... 585/530, 532, 255, 7, 585/10, 11, 12; 208/106

[56] References Cited

U.S. PATENT DOCUMENTS

| | | | |
|---|---|---|---|
| 2,642,466 | 6/1953 | Garner et al. | 208/72 |
| 2,945,076 | 7/1960 | Pardee | 585/648 |
| 3,103,485 | 9/1963 | Cahn | 208/130 |
| 3,705,926 | 12/1972 | Rumpf et al. | 585/648 |
| 4,042,488 | 8/1977 | Perciful | 208/102 |
| 4,395,578 | 7/1983 | Larkin | 585/10 |
| 4,420,646 | 12/1983 | Darden et al. | 585/10 |
| 4,827,064 | 5/1989 | Wu | 585/10 |
| 4,827,073 | 5/1989 | Wu | 585/12 |

FOREIGN PATENT DOCUMENTS 1323353 7/1973 United Kingdom .

OTHER PUBLICATIONS

JOC 88, 424–430 (1984) Weiss & Krauss.

*Primary Examiner*—Patrick P. Garvin
*Assistant Examiner*—E. D. Irzinski
*Attorney, Agent, or Firm*—Alexander J. McKillop; Charles J. Speciale; Malcolm D. Keen

[57] ABSTRACT

A process is disclosed for the production of synthetic hydrocarbon lubricants having high viscosity index by oligomerizing a mixture of alpha-olefins comprising the reaction product from the thermal cracking of refined wax. The oligomerization is carried out with Lewis acid catalyst or reduced chromium oxide on porous support.

32 Claims, No Drawings

HIGH VI SYNTHETIC LUBRICANTS FROM CRACKED REFINED WAX

This invention relates to a process for the production of synthetic lubricants from thermally cracked refined wax In particular, the invention relates to the production of high viscosity index (VI) synthetic lubricants by the oligomerization of the olefinic reaction product obtained by thermally cracking refined wax The invention further relates to the preparation of superior lubricants by oligomerizing the reaction product obtained from cracking refined wax and using reduced chromium oxide as the oligomerization catalyst.

BACKGROUND OF THE INVENTION

Mineral oil based lubricants are conventionally produced by a separative sequence carried out in the petroleum refinery which comprises fractionation of a paraffinic crude under atmospheric pressure followed by fractionation under vacuum to produce distillate fractions (neutral oils) and a residual fraction which, after deasphalting and severe solvent treatment may also be used as a lubricant base stock usually referred as a bright stock Neutral oils, after solvent extraction to remove low viscosity index (V.I.) components are conventionally subjected to dewaxing, either by solvent or catalytic dewaxing processes, to the desired pour point, after which the dewaxed lube stock may be hydrofinished to improve stability and remove color bodies. The waxes typically produced in the process of solvent dewaxing include a slack wax characterized as a lower melting point wax containing significant amounts of oil and a refined wax prepared by further solvent dewaxing of slack wax. Refined wax has a higher melting point and low oil content.

This conventional technique of lubricant production relies upon the selection and use of crude stocks, usually of a paraffinic character, which produce the desired lube fractions of the desired qualities in adequate amounts. The range of permissible crude sources may, however, be extended by the lube hydrocracking process which is capable of utilizing crude stocks of marginal or poor quality, usually with a higher aromatic content than the best paraffinic crudes. The lube hydrocracking process, which is well established in the petroleum refining industry, generally comprises an initial hydrocracking step carried out under high pressure in the presence of a bifunctional catalyst which effects partial saturation and ring opening of the aromatic components which are present in the feed. The hydrocracked product is then subjected to dewaxing in order to reach the target pour point since the products from the initial hydrocracking step which are paraffinic in character include components with a relatively high pour point which need to be removed in the dewaxing step.

Current trends in the design of automotive engines are associated with higher operating temperatures as the efficiency of the engines increases and these higher operating temperatures require successively higher quality lubricants. One of the requirements is for higher viscosity indices (V.I.) in order to reduce the effects of the higher operating temperatures on the viscosity of the engine lubricants. High V.I. values have conventionally been attained by the use of V.I. improvers e.g. polyacrylates, but there is a limit to the degree of improvement which may be effected in this way; in addition, V.I. improvers tend to undergo degradation under the effects of high temperatures and high shear rates encountered in the engine, the more stressing conditions encountered in high efficiency engines result in even faster degradation of oils which employ significant amounts of V.I. improvers. Thus, there is a continuing need for automotive lubricants which are based on fluids of high viscosity index and which are stable to the high temperature, high shear rate conditions encountered in modern engines.

Synthetic lubricants produced by the polymerization of alpha olefins in the presence of certain catalysts have been shown to possess excellent V.I. values, but they are expensive to produce by conventional synthetic procedures and usually require expensive starting materials. There is therefore a need for the production of high V.I. lubricants from mineral oil stocks which may be produced by techniques comparable to those presently employed in petroleum refineries.

It is well known that alpha olefins useful in the preparation of synthetic lubricants can be produced by the ethylene growth reactions or by cracking petroleum waxes, including slack wax. Typically, the products of ethylene growth reaction or wax cracking are separated by distillation to recover the $C_{10}$ fraction known to be especially useful in the production of the sought for high VI synthetic lubes. Oligomers of 1-alkenes from $C_6$ to $C_{20}$ have been prepared with commercially useful synthetic lubricants from 1-decene oligomerization yielding a distinctly superior lubricant product via reduced chromium, cationic or Ziegler catalyzed polymerization.

Discovering exactly those alpha olefins, and the associated oligomerization process, that produce a preferred and superior synthetic lubricant meeting the specification requirements of wide-temperature fluidity while maintaining low pour point represents a prodigious challenge to the workers in the field. Brennan, Ind. Eng. Chem. Prod. Res. Dev. 1980, 19, 2–6, cites 1-decene trimer as an example of a structure compatible with structures associated with superior low temperature fluidity wherein the concentration of atoms is very close to the center of a chain of carbon atoms. Also described therein is the apparent dependency of properties of the oligomer on the oligomerization process, i.e., cationic polymerization or Ziegler-type catalyst, known and practiced in the art. While theoretical considerations abound as to the relationship between alpha olefin structure and the lubricant properties that will ensue from oligomerization thereof, the art is, as yet, unpredictable and a relatively expensive 1-alkene, i.e., 1-decene, is commercially relied upon to provide high VI synthetic lubricant.

Recently, novel lubricant compositions (referred to herein as HVI-PAO) comprising polyalpha-olefins and methods for their preparation employing as catalyst reduced chromium on a silica support have been disclosed in U.S. Pat. Nos. 4,827,064 and 4,827,073 to M. Wu, incorporated herein by reference in their entirety. The process comprises contacting $C_6$–$C_{20}$ 1-alkene feedstock with reduced valence state chromium oxide catalyst on porous silica support under oligomerizing conditions in an oligomerization zone whereby high viscosity, high viscosity index (VI) liquid hydrocarbon lubricant is produced having branch ratios less than 0.19 and pour point below −15° C. Lubricants produced by the process cover the full range of lubricant viscosities and exhibit a remarkably high VI and low pour point even at high viscosity.

It is an object of the present invention to prepare high viscosity index synthetic lubricants from inexpensive refinery hydrocarbon products such as refined wax.

Another object of the invention is to prepare such lubricants in high yield by the catalytic oligomerization of the product mixture of olefins recovered from thermally cracking refined wax.

A further object of the invention is to prepare high quality synthetic lubricants from cracked refined wax using reduced chromium oxide as oligomerization catalyst.

SUMMARY OF THE INVENTION

A process has been discovered for the production of synthetic hydrocarbon lubricants having high viscosity index by oligomerizing a mixture of alpha-olefins comprising the reaction product from the thermal cracking of refined wax. The oligomerization is carried out with Lewis acid catalyst or reduced chromium oxide on porous support.

The process comprises contacting the olefinic hydrocarbon product mixture from the thermal cracking of refined wax with Lewis acid catalyst or reduced chromium oxide under oligomerizing conditions and separating a product comprising synthetic lubricant having a kinematic viscosity greater than 2 cS at 100° C., pour point less than −15° C. and VI greater than 120. The product is hydrogenated in contact with hydrogenation catalyst and a hydrogenated lubricant recovered having improved thermal stability.

More particularly, the process of the present invention comprises thermally cracking refined wax to produce an olefinic hydrocarbon mixture comprising a major portion of linear alpha olefins; separating the mixture to produce $C_5$–$C_{17}$ or $C_6$–$C_{16}$ hydrocarbon mixtures comprising predominantly linear alpha olefins; oligomerizing the $C_5$–$C_{17}$ or $C_6$–$C_{16}$ mixture in contact with promoted aluminum chloride catalyst; recovering a $C_{30}$+ oligomerization product comprising a synthetic lubricant having a kinematic viscosity greater than 2 cS at 100° C. and VI greater than 120; hydrogenating the oligomerization product to provide synthetic hydrocarbon lubricant having thermal stability comprising less than 35% viscosity loss upon cracking at 280° C. for 24 hours.

It has further been discovered that an especially superior synthetic lubricant can be prepared by a process which comprises contacting the olefinic hydrocarbon product mixture from the thermal cracking of refined wax under oligomerization conditions, at reaction temperature of about 0° to 250° C. with a chromium catalyst on a porous support. This catalyst has been treated by oxidation at a temperature of 200° C. to 900° C. in the presence of an oxidizing gas and then by treatment with a reducing agent at a temperature and for a time sufficient to reduce the catalyst to a lower valence state. By this process an oligomeric liquid lubricant composition is produced having a kinematic viscosity greater than about 2 cS at 100° C., a VI greater than about 130 and pour point below −15° C.

DETAIL DESCRIPTION OF THE INVENTION

Current synthetic hydrocarbon lubricants are prepared by polymerization of alpha olefins, such as 1-decene or mixtures of 1-octene to 1-dodecene produced from ethylene growth reaction. Prior to the advent of the ethylene growth process thermal cracking of refined wax or slack wax produced alpha olefins which were separated from the crackate and polymerized by boron trifluoride catalyst to provide synthetic lubricants. Slack wax and refined wax are relatively inexpensive petroleum refinery commodities which could uncouple synthetic lube production from a dependency on ethylene growth reaction and thereby lower product cost, but only if synthetic lubricants can be produced in high yield and of a quality equal to or better than those produced from ethylene growth reaction. Prior art processes have involved costly fractionation of wax crackate to provide 1-decene or narrow distributions of alpha olefins with an average carbon number of about 10 for oligomerization to quality lubes using $BF_3$ catalyst. These costly separation steps and their consequent reduction of usable crackate have negated the value of slack wax and refined wax as feedstock for 1-alkenes for synthetic lube production.

As described hereinafter, it has now been discovered that refined wax, when thermally cracked at high temperature, yields a crackate containing predominately alpha olefins. When a broad mixture of alpha olefins is recovered from the crackate and oligomerized with promoted aluminum chloride a high quality synthetic lubricant is produced characterized by a high viscosity index and low pour point. Surprisingly, it has been found that the high viscosity lube produced by $AlCl_3$ catalyzed oligomerization of the mixture of alpha olefins show superior lube properties, including high VI. It is thought that these high viscosity materials are less sensitive to the properties of the starting alpha olefins. Hence, superior lubes are produced from a mixture of alpha olefins.

When chromium oxide is used as oligomerization catalyst the refined wax thermal cracked product polymerizes to a synthetic lubricant of very high VI with overall properties distinctly superior to those of commercial 1-decene produced synthetic lubricant.

While not wishing to be bound by theoretical considerations, it is thought that several factors relating to refined wax composition and to the process employed in the instant invention combine to produce the surprising results achieved with respect to the production of a high VI synthetic lube. First, it is thought that the thermal cracking process carried out on refined wax results in considerably less isomerization and branching of alpha olefins compared to catalytic cracking. Since it is known that a relationship exists between branch ratio in a lube oligomer and VI, there is a strong indication of a relationship between the structure of the alpha olefins produced by the thermal cracking process of this invention and the high VI of the lube oligomer produced therefrom. Second, refined wax, recovered from a repetitive solvent dewaxing process, has a low content of aromatics and other impurities which can act as poisons for reduced chromium oxide catalyst. Accordingly, it has been found that the product from thermally cracking refined wax can be oligomerized by reduced chromium oxide.

FEED

The feed to the process of the instant invention comprises a refined petroleum wax which contains not more than 5 weight percent oil, as determined by ASTM test D-3235 or ASTM D-721. As described hereinafter, these refined waxes are distinguished over slack wax by oil content which for slack wax is typically 10 to 50% oil. In these feeds of mineral oil origin, the waxes are mostly paraffins of high pour point, comprising straight chain and slightly branched chain paraffins such as methylparaffins.

Petroleum waxes, that is, waxes of paraffinic character are derived from the refining of petroleum and other liquids by physical separation from a wax-containing refinery stream, usually by chilling the stream to a temperature at which the wax separates, usually by solvent dewaxing, e.g., MEK/toluene dewaxing or by means of an autorefrigerant process such as propane dewaxing. These waxes have high initial boiling points above about 650° F. (about 345° C.) which render them extremely useful for processing into lubricants which also require an initial boiling point of at least 650° F. (about 345° C.). The presence of lower boiling components is not to be excluded since they will be removed together with products of similar boiling range produced during the processing by the separation steps which follow the characteristic processing steps. Since these components will, however, load up the process units they are preferably excluded by suitable choice of feed cut point. The end point of wax feeds derived from the solvent dewaxing of neutral oils i.e. distillate fractions produced by the vacuum distillation of long or atmospheric resids will usually be not more than about 1100° F. (about 595° C.) so that they may normally be classified as distillate rather than residual streams. But high boiling wax feeds such as petroleum waxes, i.e., the waxes separated from bright stock dewaxing, which may typically have an end point of up to about 1300° F. (about 705° C.), may also be employed.

The wax content of the feed for the instant invention is high, generally at least 95%, more usually at least 97 to 98 weight percent with the balance from occluded oil being divided between aromatics and naphthenics. The non-wax content of aromatics, polynaphthenes and highly branched naphthenes will normally not exceed about 5 weight percent of the wax and preferably will not exceed 2 to 3 weight percent. Highly paraffinic wax stocks usually have low viscosities because of their relatively low content of aromatics and naphthenes although the high content of waxy paraffins give them melting points and pour points which render them unacceptable as lubricants without further processing.

Feeds comprising the waxy product obtained directly from a solvent dewaxing process, e.g. an MEK or propane dewaxing process are slack wax. The slack wax, which is a solid to semi-solid product, comprising mostly highly waxy paraffins (mostly n- and monomethyl paraffins) together with occluded oil, may be fed directly to another, or repetitive, solvent dewaxing step and refined wax, or recycled wax, recovered by chilling. This process removes most of the oils contained in slack wax and provides a higher melting point, purer wax product useful in the present invention.

Refined waxes useful in the present invention are commercially available, such as MOBILWAX 130, 135, 140 and 145. These waxes are composed of normal, straight chain hydrocarbons containing between 18 and 40 carbon atoms. Their properties are listed in Table 1.

TABLE 1

| Mobilwax | 130 | 135 | 140 | 145 |
|---|---|---|---|---|
| Melting Pt., °C. | 54 | 57 | 61 | 63 |
| Flash Pt., °C. | 216 | 221 | 227 | 232 |
| Blocking Pt., °C. | 38 | 43 | 44 | 52 |
| Visc. cS @ 100° C. | 3.45 | 4.13 | 4.50 | 4.85 |
| Oil Content, Wt. % | 0.3 | 0.3 | 0.3 | 0.3 |

These and other refined waxes provide the feedstock to the thermal cracking step of the instant invention that yields the mixture of linear alpha-olefins (LAO) found to be oligomerizable with Lewis acid or reduced chromium oxide catalyst to produce high VI synthetic hydrocarbon lubricants.

THERMAL CRACKING

An important aspect of the present invention is that refined wax feedstock is thermally cracked under conditions suitable for the production of a crackate, or product of the cracking process, containing predominantly alpha olefins. Thermal cracking is well known in the refinery art and the present thermal cracking process can be carried out in a variety of process configurations, continuous or batch-wise. Typically, the hot wax is feed to the top of a vertical reactor containing vycor chips or other inert material. The wax is effectively cracked at a temperature between about 950° F. and 1200° F. (510° C.-648° C.) and a pressure between about 50 kPa and 980 kPa at a liquid hourly space velocity (LHSV) between about 0.3 and 20. A preferred cracking temperature is about 590° C. and a preferred pressure is about 103 kPa at a LHSV of about 2. In practice, the wax feed is typically diluted with 1 to 70 percent by volume of an inert gas such as nitrogen or steam. Following thermal cracking the cracking product is fractionally distilled and fractions having carbon number between five and eighteen collected and combined as feedstock for subsequent polymerization to synthetic lubricant.

Thermal cracking of refined wax, such as Mobilwax 130, as describe above provides the products listed in Table 2.

TABLE 2

Products from Mobilwax 130 Thermal Cracking

| Cracking Temp. °C. | 580 | 590 | 610 | 630 |
|---|---|---|---|---|
| $C_{19}$+ conversion, Wt % | 35.7 | 41.1 | 58.4 | 74.1 |
| Yields, Wt %: | | | | |
| $C_4$− | 9.1 | 9.9 | 18.1 | 28.2 |
| $C_5$-$C_6$ | 3.8 | 5.2 | 8.5 | 12.3 |
| $C_7$-$C_{17}$ | 20.1 | 24.1 | 29.2 | 31.4 |
| $C_6$ LAO purity* Wt % | 92 | 88 | 78 | 75 |
| Wt % selectivities: | | | | |
| $C_1$ | 2.3 | 2.1 | 2.7 | 3.2 |
| $C_2$ | 4.2 | 3.7 | 5.6 | 6.1 |
| $C_2$= | 8.1 | 7.5 | 9.0 | 11.1 |
| $C_3$ | 1.2 | 1.0 | 1.1 | 1.1 |
| $C_3$= | 5.3 | 4.9 | 6.7 | 8.6 |
| $C_4$ | 0.2 | 0.5 | 0.2 | 0.2 |
| $C_4$= | 4.1 | 3.8 | 5.3 | 6.9 |
| $C_5$'s | 2.9 | 4.3 | 5.1 | 6.5 |
| $C_6$'s | 7.8 | 8.4 | 9.4 | 10.0 |
| $C_7$-$C_{17}$ | 56.3 | 58.2 | 50.0 | 42.4 |

*$C_6$ LAO purity is percent normal 1-hexene in the $C_6$ fraction.

OLIGOMERIZATION

1. Lewis Acid Catalyst

The oligomerization feedstock mixture typically comprises a $C_5$-$C_{18}$ fraction or $C_6$-$C_{16}$ fraction of olefinic hydrocarbons from fractionation of the thermal cracking product. A preferred fraction is $C_6$-$C_{17}$ olefinic hydrocarbons. It has been found that using a narrower cut of olefinic hydrocarbons can improve the lube product properties, but at the cost of reducing lube yields. Decreasing the amount of $C_5$–$C_6$ hydrocarbons in the oligomerization feedstock generally boosts the VI of the lube product, and decreasing the amount of $C_{16}$–$C_{18}$ generally improves lube pour point. However, in the present invention it has been found that using a feedstock comprising $C_5$–$C_{18}$ or $C_6$–$C_{16}$ hydrocarbons provides lube products with surprisingly high VI. Prior to oligomerization the feedstock is purified to remove moisture and oxygenated organic compounds such as alcohols, ethers and esters which would interfere with the oligomerizations process. Oligomerization is carried out using a Lewis acid catalyst such as aluminum chloride, boron trifluoride, $SnCl_4$ and the like. A promoted aluminum chloride is the preferred catalyst. Effective promoters for use with Lewis acids include those well known in the art and particularly protonic promoters such as alcohols, carboxylic acids or water. With aluminum chloride as used in the present invention water is an effective promoter. Generally, the mole ratio of $AlCl_3$ to water added as promoter is between 10 and 0.1. A mole ratio of about 1 to 2 is preferred.

The oligomerization may be carried batch-wise or continuous; neat or in solution. Useful solvents include non-reactive hydrocarbons, particularly paraffinic materials such as cyclohexane, octane or higher hydrocarbons. The process is carried out under oligomerization conditions comprising temperature between about 0° C. and 250° C. for a time sufficient to produce the synthetic lubricant. A wide range of pressures can be used, but typically between 1000 kPa and 35 kPa. Preferably, the oligomerization is carried out at about atmospheric pressure (102 kPa). Less than 10 weight percent of catalyst is employed, based on olefin in the feedstock, but higher amounts may be used. Preferably, about five weight percent of $AlCl_3$ catalyst is used, based on olefin.

Following the oligomerization step the catalyst is removed by washing with dilute acid, base and water and the organic product is separated by distillation to remove components boiling below 400° C. The product recovered has a kinematic viscosity measured at 100° C. between above 1 cS and 300 cS, typically between 10 and 300 cS when $AlCl_3$ is used as catalyst; a viscosity index above about 130 and a pour point below −15° C.

2. Reduced chromium catalyst

The alpha-olefin mixture from thermal cracking of refined wax is also oligomerized by supported metal oxide catalysts, such as Cr compounds on silica or other supported IUPAC Periodic Table Group VIB compounds. The catalyst most preferred is a lower valence Group VIB metal oxide on an inert support. Although excellent catalytic properties are possessed by the lower valence state of Cr, especially CrII; conversion can be achieved to a lesser degree by reduced tungsten (W) and molybdenum (Mo) compounds. Preferred supports include silica, alumina, titania, silica alumina, magnesia and the like. The support material binds the metal oxide catalyst. Those porous substrates having a pore opening of at least 40 Angstroms are preferred.

The support material usually has high surface area and large pore volumes with average pore size of 40 to about 350 (A) angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of 60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$ or metal alkyl containing compounds.

Alternatively, the Group VIB metal may be applied to the substrate in reduced form, such as CrII compounds. The resultant catalyst is very active for oligomerizing olefins at a temperature range of about 90°–250° C. (preferably 100°–180° C.) at autogenous pressure, or about 0.1 atmosphere to 5000 psi. Contact time can vary from one second to 24 hours; however, the weight hourly space velocity (WHSV) is really about 0.1 to 10 based on total catalyst weight. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities greater than 2 cS at 100° C. with high viscosity indices suitable for high performance lubrication use. Viscosity indices greater than 130 are produced with pour points below −15° C. The product oligomers are separated by distillation to remove components boiling below 400° C.

3.Hydrogenation

According to the practice typical in the petroleum lubricant arts the products from Lewis acid or reduced chromium catalyzed oligomerization are hydrogenated to saturate residual olefinic bonds. Hydrogenation can be carried out by any of numerous methods well known to those skilled in the art. A preferred method is to hydrogenate the product at elevated temperature and pressure in contact with Pd or Pt on charcoal. It has been discovered that when the hydrogenated product is tested for thermal stability by heating at 280° C. under nitrogen for 24 hours and the results compared to those achieved by synthetic lube produced by oligomerization of mixtures of alpha olefins from ethylene growth reaction or by oligomerization of 1-decene the product of this invention shows a thermal stability comparable to the commercial synthetic hydrocarbon lubricants.

In the following Examples the process of the invention is specifically described and the characterization of the products depicted.

EXAMPLE 1

Thermal cracking

A refined wax of melting point 54° C., oil content 0.3 wt% and composition of $C_{21}$–$C_{32}$ by gas chromatograph, was used as starting material. It was thermally cracked at atmospheric pressure in a stainless steel reactor of 158" id, 10.5" long, equipped with a concentrical ⅛" od thermal well and filled with 45 cc of 4/16 mesh vycor chips. Melted wax was fed from an Isco pump to the top of the reactor along with 30 cc/minute nitroger. The products were directed to a recovery train consisting of a 120° C. receiver and then a 0° C. condenser. Gases leaving the condenser went to vent or to a gas collection system for analysis.

Cracking runs were made at 580°, 590°, 610° and 630° C. Results are summarized in Table 2. Optimum conversion and selectivities were achieved at 590° C.

About 80% of the $C_5$ fraction was normal 1-pentene. The 1-hexene content of the $C_6$ fraction varied from 75% to 92%, dropping with increasing temperature. A gas chromatogram of the $C_{10+}$ portion of the product from a 590° C. run shows that the main $C_{22}$–$C_{32}$ peaks are the unconverted paraffins. The major $C_{20-}$ peaks appear to represent normal alpha-olefins at about 85% purity. For $C_{21}$, the parent paraffin and the product olefin peaks are about the same size. The weight fraction of each carbon number in the $C_7$–$C_{18}$ product decreases slightly with increasing carbon number.

The $C_6$–$C_{16}$ cut from the 590° C. runs was analyzed using 200 MHz H-nmr to determine the relative amounts of various types of olefins, both before and after purification by molecular sieve and Deox. The relative molar olefin concentrations were:

| | alpha | disubstituted | vinylidene |
|---|---|---|---|
| Before purification | 90.6 | 6.9 | 2.5 |
| After purification | 88.3 | 6.9 | 4.7 |

Thus the olefins present in this $C_6$–$C_{16}$ cut, about 90% were alpha-olefins. The nmr results also indicated that there was less than 0.01 mole of aromatic rings present per mole of olefins.

The combined effluent was fractionated to give a fraction of the following composition, equivalent to an average $C_{11}$ olefins.

$C_6$, 2.0%; $C_7$, 4:0%; $C_8$, 5.6%; $C_9$, 8.6%; $C_{10}$, 14.0%; $C_{11}$, 13.9%; $C_{12}$, 13.6%; $C_{13}$, 14.3%; $C_{14}$, 14.4%; $C_{15}$, 7.8%; $C_{16}$, 1.6%.

This mixture was purified over 13X molecular sieve and reduced copper chromite catalyst to remove moisture and oxygenate compounds before use for lube synthesis.

EXAMPLE 2

Polymerization by Chromium Catalyst

The purified olefin mixture, 20 grams, prepared in Example 1, was mixed with two grams of an activated Cr on silica catalyst. This catalyst was prepared by impregnating a silica gel, Davisil 646 (300 $m^2/g$, 1.12 cc/g, 35–60 mesh) with chromic oxide in water, followed by calcination with air at 800° C. and reduction with CO at 350° C. The mixture was heated under nitrogen atmosphere to 125° C. for 16 hours. The lube product was isolated in 80% yield after distillation to remove light components boiling below 750° F. The lube product was hydrogenated at 100° C. and 400 psi with 2 wt% Pd (5%) on activated carbon catalyst for four hours. The viscometric properties and thermal stabilities of the hydrogenated lube (Sample A) and other comparative products are summarized below in Table 3.

TABLE 3

| Samples | Starting Olefin Type | V @ 100° C. cS | VI | Pour Point °C. | % Viscosity loss cracked @ 280° C. (c) |
|---|---|---|---|---|---|
| A | $C_6$–$C_{16}$ from wax cracking, Example 1 | 110.01 | 191 | −35 | 67 |
| B | $C_6$–$C_{20}$ from $C_2H_4$ growth reaction (a) | 81.57 | 190 | −24 | — |
| C | $C_6$–$C_{14}$ from ethylene growth reaction (b) | 127 | 197 | −33 | — |
| D | 1-decene from ethylene growth reaction | 110 | 204 | −40 | 65 |

(a) Sample B lube was prepared from a mixture containing $C_6$ to $C_{20}$ alpha-olefins in similar manner as Sample A. The alpha-olefin mixture has the same composition as the commercial alpha-olefin mixture produced from the ethylene growth process of Chevron Chemical Co. This mixture contains $C_6$ 4.7%, $C_8$ 12.8%, $C_{10}$ 22%, $C_{12}$ 19.4%, $C_{14}$ 16%, $C_{16}$ 11%, $C_{18}$ 7.7%, $C_{20}$ 6.5%, with average size of $C_{11}$.

(b) Sample C lube was prepared from a mixture containing $C_6$ to $C_{14}$ alpha-olefins in similar manner as Sample A. The alpha-olefin mixture has the same composition as the alphaolefin mixture produced from the ethylene growth process of Ethyl Corporation. This mixture contains $C_6$ 16%, $C_8$ 25%, $C_{10}$ 26%, $C_{12}$ 20%, $C_{14}$ 12%, with average size of $C_9$.

(c) % viscosity loss was measured by heating 10 gram sample in a round-bottom flask at 280° C. under nitrogen atmosphere for 24 hours. At this high temperature, the lube was thermally cracked into smaller molecules with lower viscosity.

Table 3 shows that the lube from wax-derived alpha-olefins (Sample A) had similar viscometric properties and thermal stability as the lubes from alpha-olefin mixtures from ethylene growth reactions (Sample B or Sample C) or from pure 1-decene (Sample D).

EXAMPLE 3

Polymerization by Promoted $AlCl_3$ Catalyst

Anhydrous aluminum chloride powder, 0.4g, was added to the olefin mixture, 20 grams, produced in Example 1, containing 150 micro-liter water and preheated to 50° C. under nitrogen. The reaction mixture was stirred at 50° C. for 16 hours. The aluminum chloride catalyst was destroyed by washing with 30 cc dilute HCl, dilute NaOH and water. The organic product was dried and distilled to remove light components boiling below 750° F. The lube was then hydrogenated similar as in Example 2. The properties of the finished lube (Sample E) and comparative products are summarized in the following Table 4.

TABLE 4

| Samples | Starting Olefin Type | V @ 100° C. cS | VI | Pour Point °C. | % Viscosity loss cracked @ 280° C. (c) |
|---|---|---|---|---|---|
| E | $C_6$–$C_{16}$ from wax cracking, Example 1 | 43.78 | 152 | −35 | 31 |
| F | $C_6$–$C_{14}$ from ethylene growth reaction (a) | 47.70 | 143 | −45 | 25 |
| G | 1-decene from ethylene growth reaction (b) | 43.08 | 150 | −34 | 23 |

(a) Sample F lube was prepared from a mixture containing $C_6$ to $C_{14}$ alpha-olefins in similar manner as Sample E. The alpha-olefin mixture has the same composition as the alphaolefin mixture produced by Ethyl Corporation's ethylene growth process. This mixture contains $C_6$ 16%, $C_8$ 25%, $C_{10}$ 26%, $C_{12}$ 20%, $C_{14}$ 12%, with average carbon of $C_9$.

(b) This product is similar to the commercial 1-decene oligomer currently produced by Mobil Chemical Co.

(c) % viscosity loss was measured by heating 10 gram sample in a round-bottom flask at 280° C. under nitrogen atmosphere for 24 hours.

Table 4 shows that the lube from wax-derived alpha-olefins (Sample E) had similar viscometric properties and thermal stability as the lubes from alpha-olefin mixtures from ethylene growth reaction (Sample F) or from pure 1-decene (Sample G).

The following Table 5 compares viscosity losses of lube products prepared from 1-decene and olefins from refined wax cracking by oligomerization catalyst type when cracked at 280° C. for 24 hours:

TABLE 5

| Starting Material | Catalyst Type | V @ 100° C. cS | % Loss at 280° C. V @ 100° C. | % Loss at 280° C. V @ 40° C. |
|---|---|---|---|---|
| 1-Decene | $Cr/SiO_2$ | 145 | 65 | 76 |
| $C_6$–$C_{16}$ Olefins | $Cr/SiO_2$ | 110 | 67 | 74 |
| 1-Decene | $AlCl_3$ | 43.78 | 23 | 31 |
| $C_6$–$C_{16}$ Olefins | $AlCl_3$ | 43.08 | 31 | 39 |

The thermal stabilities, in % viscosity loss, are identical for the oligomers produced over an activated $Cr/SiO_2$ catalyst from 1-decene and from mixed alpha-olefins derived from wax cracking. The oligomer produced from mixed alpha-olefins over $AlCl_3$ catalyst exhibited somewhat lower thermal stability than the corresponding oligomer made from 1-decene. The 8% difference in viscosity loss may be within experimental error for this test. The available data thus indicate that the polymer produced from mixed alpha-olefin has thermal stability comparable to that of the polymer produced from 1-decene.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A process for the production of high VI synthetic lubricants, comprising;

contacting the $C_5$–$C_{18}$ portion of the alpha-olefinic hydrocarbon product mixture from the thermal cracking of refined or recycled wax with an aluminum trichloride oligomerization catalyst under oligomerizing conditions and separating a product comprising synthetic lubricant having a kinematic viscosity greater than 1 cS at 100° C., pour point less than −15° C. and VI greater than 120.

2. The process of claim 1 comprising the further step of hydrogenating said synthetic lubricant in contact with hydrogenation catalyst and recovering hydrogenated lubricant.

3. The process of claim 1 wherein said mixture comprises $C_5$–$C_{18}$ hydrocarbons containing at least 70 weight percent linear alpha olefins.

4. The process of claim 1 wherein said mixture comprises $C_6$–$C_{16}$ hydrocarbons having an average carbon number of about 10.

5. The process of claim 1 wherein said mixture contains at least 80 weight percent linear alpha olefins.

6. The process of claim 1 wherein said aluminum chloride is promoted with water.

7. The process of claim 1 wherein said oligomerization conditions comprise temperature between about 0° C. and 250° C. for a time sufficient to produce said synthetic lubricant and less than 10 weight percent of said catalyst.

8. The process of claim 7 wherein said temperature is about 50° C.

9. The process of claim 1 wherein said refined wax is thermally cracked at a temperature between about 500° C. and 650° C. at a pressure from about 50 kPa to about 1050 kPa, then fractionated to provide said product mixture comprising $C_5$–$C_{18}$ olefinic hydrocarbons containing linear alpha olefins.

10. A synthetic lubricant according to the process of claim 1.

11. A synthetic lubricant according to the process of claim 2.

12. A combined process for the production of high VI synthetic lubricant having improved, thermal stability, comprising:

a) thermally cracking refined wax to produce an olefinic hydrocarbon mixture comprising a major portion of linear alpha olefins;

b) separating said mixture to produce $C_5$–$C_{18}$ hydrocarbon mixture comprising predominantly linear alpha olefins;

c) oligomerizing said C5–$C_{18}$ mixture in contact with promoted aluminum chloride catalyst;

d) recovering a $C_{30+}$ oligomerization product comprising a synthetic lubricant having a kinematic viscosity greater than 1 cS at 100° C. and VI greater than 120;

e) hydrogenating said oligomerization product to provide synthetic hydrocarbon lubricant having enhanced thermal stability.

13. The process of claim 13 wherein step (b) mixture is separated to provide $C_6$–$C_{16}$ hydrocarbon mixture for oligomerization in contact with promoted aluminum chloride catalyst.

14. The process of claim 13 wherein said mixture comprises $C_6$–$C_{16}$ hydrocarbons having an average carbon number of about 10.

15. The process of claim 12 wherein step (c) mixture is oligomerized at a temperature between about 0° C.

and 250° C. for a time sufficient to produce said synthetic lubricant.

16. The process of claim 15 wherein said temperature is about 50° C.

17. The process of claim 12 wherein said refined wax is thermally cracked at a temperature between about 500° C. and 650° C. at a pressure from about 50 kPa to about 1050 kPa.

18. A process for the preparation of liquid hydrocarbons suitable as lubricant basestock, comprising: contacting the olefinic hydrocarbon product mixture from the thermal cracking of refined wax under oligomerization conditions, at reaction temperature of about 0° to 250° C. with a chromium catalyst on a porous support, which catalyst has been treated by oxidation at a temperature of 200° C. to 900° C. in the presence of an oxidizing gas and then by treatment with a reducing agent at a temperature and for a time sufficient to reduce said catalyst to a lower valence state; whereby an oligomeric liquid lubricant composition is produced having a kinematic viscosity greater than about 2 cS at 100° C., a VI greater than about 130 and pour point below −15° C.

19. The process of claim 18 wherein said reducing agent comprises CO, the oligomerization temperature is about 100°-180° C., and the yield of liquid lubricant is at least 85 wt% .

20. The process of claim 18 comprising the further step of hydrogenating said lubricant in contact with hydrogenation catalyst and recovering hydrogenated lubricant.

21. The process of claim 18 wherein said mixture comprises $C_5$-$C_{18}$ hydrocarbons containing at least 70 weight percent linear alpha olefins.

22. The process of claim 18 wherein said mixture comprises $C_6$-$C_{16}$ hydrocarbons having an average carbon number of about 10.

23. The process of claim 18 wherein said mixture contains at least 80 weight percent linear alpha olefins.

24. The process of claim 28 wherein said refined wax comprises paraffinic hydrocarbons obtained by solvent dewaxing of slack wax.

25. The process of claim 18 wherein said refined wax is thermally cracked at a temperature between about 500° C. and 650° C. at a pressure from about 50 kPa to about 1050 kPa, then fractionated to provide said product mixture comprising $C_5$-$C_{17}$ olefinic hydrocarbons containing linear alpha olefins.

26. A process for oligomerizing the $C_5$-$C_{18}$ hydrocarbon portion of the alpha-olefinic product mixture from thermal cracking of refined wax to produce lubricant range hydrocarbon comprising contacting said mixture with a supported solid reduced metal oxide catalyst under oligomerization conditions at a temperature of about 0° to 250° C.; said metal oxide comprising a lower valence form of at least one Group VIB metal to produce lubricant range hydrocarbon product having a kinematic viscosity greater than about 2 cS at 100° C., a VI greater than about 140 and pour point below −15° C.

27. The process of claim 26 wherein said refined wax is thermally cracked at a temperature between about 500° C. and 650° C. at a pressure from about 50 kPa to about 1050 kPa, then fractionated to provide said product mixture comprising $C_5$-$C_{17}$ olefinic hydrocarbons containing linear alpha olefins.

28. The process of claim 26 wherein said metal oxide comprises CO reduced chromium oxide.

29. The process of claim 28 comprising the further step of hydrogenating said synthetic lubricant in contact with hydrogenation catalyst and recovering hydrogenated lubricant.

30. The process of claim 26 wherein said refined wax comprises paraffinic hydrocarbons obtained by solvent dewaxing of slack wax.

31. The process of claim 26 wherein said mixture comprises $C_5$-$C_{18}$ hydrocarbons containing at least 70 weight percent linear alpha olefins.

32. The process of claim 26 wherein said mixture comprises $C_6$-$C_{16}$ hydrocarbons having an average carbon number of about 10.

* * * * *